United States Patent [19]

Garay et al.

[11] Patent Number: 5,075,691

[45] Date of Patent: Dec. 24, 1991

[54] MULTI-RESONANT LAMINAR ANTENNA

[75] Inventors: Oscar Garay, Coral Springs; Quirino Balzano, Plantation; Thomas J. Manning, Sunrise, all of Fla.

[73] Assignee: Motorola, Inc., Schaumburg, Ill.

[21] Appl. No.: 383,473

[22] Filed: Jul. 24, 1989

[51] Int. Cl.[5] ..... H01Q 1/38; H0iQ 21/26

[52] U.S. Cl. ..... 343/830; 343/700 MS; 343/797; 343/826

[58] Field of Search ..... 343/700 MS, 702, 829, 343/846, 795, 797, 789, 769, 826, 830

[56] References Cited

U.S. PATENT DOCUMENTS

| | | | |
|---|---|---|---|
| 4,054,874 | 10/1977 | Oltman | 343/700 MS |
| 4,138,681 | 2/1979 | Davidson et al. | 343/702 |
| 4,356,492 | 10/1982 | Kaloi | 343/700 MS |
| 4,652,889 | 3/1987 | Bizouard et al. | 343/700 MS |
| 4,760,400 | 7/1988 | Lait | 343/700 MS |
| 4,800,392 | 1/1989 | Garay et al. | 343/700 MS |
| 4,804,965 | 2/1989 | Roederer | 343/700 MS |
| 4,833,482 | 5/1989 | Trinh et al. | 343/700 MS |
| 4,864,314 | 9/1989 | Bond | 343/700 MS |

FOREIGN PATENT DOCUMENTS

| | | | |
|---|---|---|---|
| 2064877 | 6/1981 | United Kingdom | 343/700 MS |
| 2152757 | 8/1985 | United Kingdom | 343/700 MS |

OTHER PUBLICATIONS

Holzheimer "Thick, Multilayer Elements Widen Antenna Bandwidths" Microwave & RF—Feb. 1985—pp. 93-99 and 113.

Bancroft "Accurate Design of Dual-Band Patch Antennas" Microwaves & RF—Sept. 1988—pp. 113-114 and 116, 118.

Griffin et al. "Broadband Circular Disc Microstrip Antenna" Electronics Letters—Mar. 18, 1982 vol. 18 No. 6—pp. 266-269.

Yokoyama et al. "Dual-Resonance Broadband Microstrip Antenna" Proceedings of ISAP '85—pp. 429-431.

Vaughn et al. "A Multiport Patch Antenna for Mobile Communications" From 14th European Microwave Conference 1984—pp. 607-612.

Gupta et al. "A New Broadband Microstrip Antenna" Conference on Antennas and Communications pp. 96-99—Sep. 29-Oct. 1, 1986.

"Antennas" by John D. Kraus, pp. 704-705.

*Primary Examiner*—Michael C. Wimer

*Attorney, Agent, or Firm*—Juliana Agon

[57] ABSTRACT

A multi-resonant antenna is formed by a plurality of resonators which resonate at different frequencies. A feed member is coupled to the multi-resonant resonators. Disposed between and separating the resonators from the feed member is a dielectric substrate.

5 Claims, 3 Drawing Sheets

MULTI-RESONANT LAMINAR ANTENNA

TECHNICAL FIELD

This invention relates generally to antennas, and more specifically to micro-strip antennas.

BACKGROUND ART

For portable communication devices such as two-way radios and pagers, the current trend in radio design is towards product miniaturization. One of the largest components in the radio, is the antenna. To reduce the antenna size, one solution is to use conventional micro-strip antennas, where the resonators are printed on a substrate using conventional thick or thin film processing.

Another trend in radio design is to use one broadband antenna for multi-frequency operation. Since one antenna would eliminate the inconvenience of storing multiple parts, a low-profile broadband antenna is desired. However, micro-strip antennas (resonators) are inherently narrow band. To broaden a single microstrip antenna, one solution has been to stack a set of micro-strip antennas of different resonant frequencies on top of each other. In this way, the resonant frequencies of each antenna combine to simulate a broadband frequency response.

Unfortunately, stacked antennas along with the associated matching network increase the thickness of the antenna. In many radios there is less room for a thickness increase than a width increase.

In addition, exciting multiple resonators requires multiple individual feeds. Often, the feed is accomplished by a feed probe that protrudes through a dielectric layer. For manufacturing simplicity, drilling through dielectric layer is not favored. Therefore, a low-profile broadband antenna with a single external feed is desired.

SUMMARY OF THE INVENTION

Accordingly, it is an object of the present invention to provide a low-profile broadband antenna with integral matching and a single external feed.

Briefly, according to the invention, a multi-resonant antenna comprises a plurality of resonators which resonate at different frequencies. A feed member is coupled to the multiplicity of resonators. Disposed between and separating the resonators from the feed member is a dielectric substrate.

DETAILED DESCRIPTION OF THE PREFERRED EMBODIMENT

Figure 1:
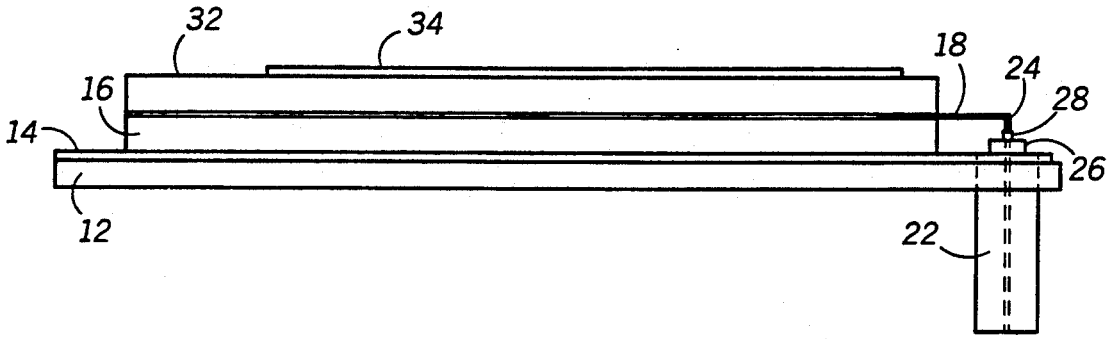
FIG. 1 is a side-view of an antenna in accordance with the present invention.

Referring to FIG. 1, the assembly of an antenna in accordance with the present invention is shown. Using common thick or thin film processing, metal is deposited on top of a substrate 12 to form a ground plane 14. The material of the substrate 12 may be ceramic or be formed from any other suitable material. Located on top of the ground plane 14 is a layer of dielectric material 16. A thin feed member 18 is placed on top and extends beyond a portion of the dielectric layer 16 for attachment to a 50 ohm connector 22 via a center conducting feed line 24. The ground 26 of the conductor 22 is suitably connected to the ground plane 14. As is common in 50 ohm connectors, an insulator 28 insulates the center feed line from ground. As illustrated, the 50 ohm connector 22 is located external to the dielectric material 16 for ease of assembly (to not have to drill through the dielectric material).

A top layer of dielectric material 32 is located on top of the feed member 18 and the rest of the uncovered bottom dielectric layer 16. The two layers of dielectric material may be bonded together with a conventional thick or thin-film agent or sandwiched together by other suitable means. Finally, a metal pattern 34 is deposited or laminated (formed such as by conventional thin-film photo-imaging process) atop the top dielectric layer 32 and overlays a portion of the feed member 18.

Figure 2:
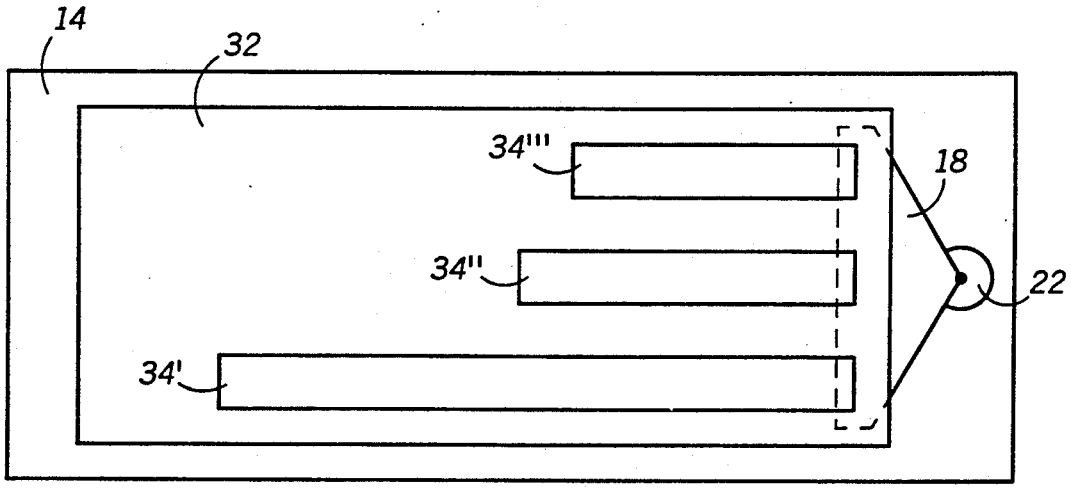
FIG. 2 is a top view of the antenna of FIG. 1.

Referring to FIG. 2, the metal pattern 34 comprises a plurality of substantially rectangular strips 34', 34'' and 34''' which are of different lengths to resonate at different frequencies as determined by the air above and the dielectric material 32 below. However, by using a different dielectric material below each resonator, the resonating strips can be made (laminated) to be of the same lengths and still resonate at different frequencies to form similar resonators.

The tapered polygonal feed member 18 excites the resonating strips 34', 34'' and 34''' by capacitive coupling. The length of the feed member 18 at its rectangular end being overlayed by the top resonators 34 and the distance between the feed member 18 and the resonating strips 34', 34'', and 34''' provide the proper matching for the antenna at the 50 ohm connector input 22. For optimum capacitive coupling, the thinner the layer of resonating strips 34', 34'', and 34''', the less overlap is needed. In this way, the excitation of multiple resonators 34', 34'', and 34''' is accomplished with one external feed 22.

Figure 3:
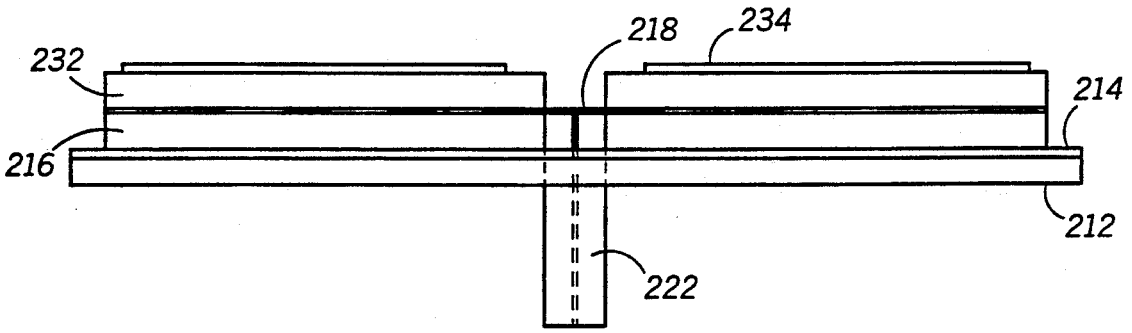
FIG. 3 is a side-view of an alternate embodiment of an antenna in accordance with the present invention.

Referring to FIG. 3, an alternate embodiment of the present invention is shown to excite the resonators of different polarizations using the same concepts. A 50 ohm connector 222 (the same connector 22 is shown simplified from hereon) is attached to the center of a substrate 212. As before, a metal pattern 234 is deposited on top of a top dielectric layer 232 which covers a portion of a feed member 218 which is atop a bottom dielectric layer 214. The bottom dielectric layer is located on top of a ground plane 214 which is deposited on top of the substrate 212.

Figure 4:
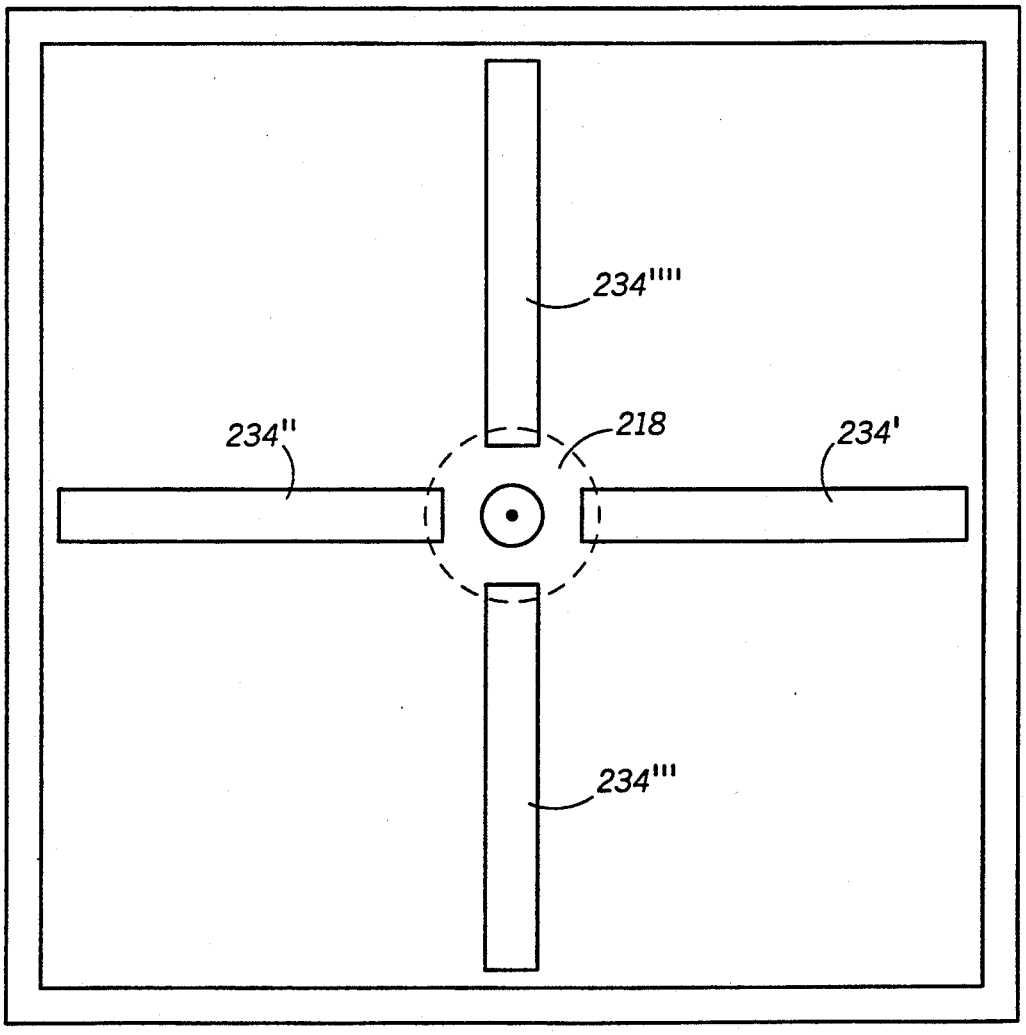
FIG. 4 is a top view of the antenna of FIG. 3.

Referring to FIG. 4, a top view of the alternate embodiment of FIG. 3 is shown. The feed member 218 is circular in this embodiment to accommodate the multi-resonating strips 234' and 234'' of one polarization and 234''' and 234'''' of the orthogonal polarization, which are radially disposed relative to the feed member 218. Again, the excitation of multiple resonators 234', 234'', 234''', and 234'''', is accomplished by a single feed 222 which does not protrude through the dielectric layers 232 and 214.

Figure 5:
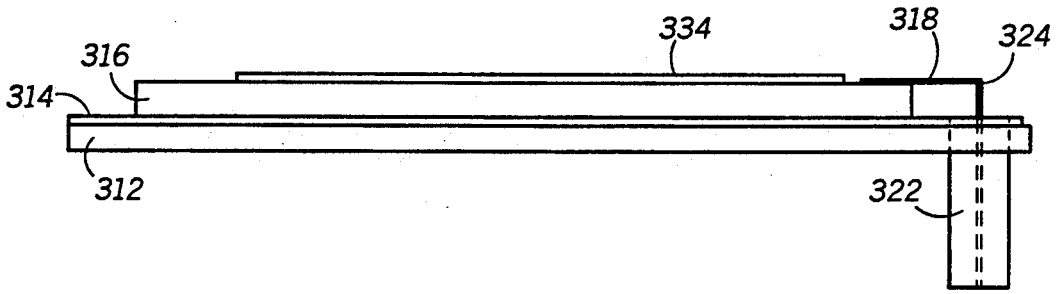
FIG. 5 is a side-view of another alternate embodiment of an antenna in accordance with the present invention.

Referring to FIG. 5, another alternate embodiment of the antenna in accordance with the present invention is shown. As before, metal is deposited on top of a substrate 312 to form a ground plane 314. Located on top of the ground plane 314, is a layer of dielectric material 316. A feed member 318 is placed on top and extends beyond a portion of the dielectric layer 316 for attachment to a 50 ohm connector 322 via a center conducting feed line 324. As illustrated, the 50 ohm connector 322 is located external to the dielectric material 316.

A metal pattern 334 is also deposited or laminated atop the dielectric layer 316 and is capacitively coupled (not physically connected) to the feed member 318.

Figure 6:
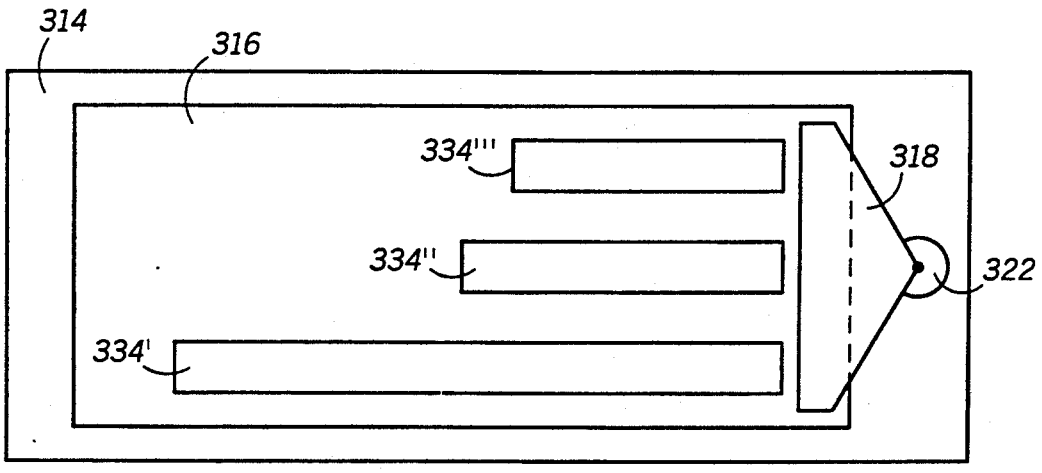
FIG. 6 is a top view of the antenna of FIG. 5.

Referring to FIG. 6, the metal pattern 334 comprises a plurality of substantially rectangular strips 334', 334'' and 334''' which are of different lengths to resonate at different frequencies as determined by the air above and the dielectric material 316 below.

The tapered polygonal feed member 318 excites the resonating strips 334', 334'', and 334''' by capacitive coupling. The distance between the feed member 318 and the resonating strips 34', 34'', and 34''' help provide the proper matching for the antenna at the 50 ohm connector input 322. For optimum capacitive coupling, the wider the resonating strips 34', 34'', and 34''', the less spacing is needed between the feed member 318 and the strips. In this way, the excitation of multiple resonators 334', 334'', and 334''' is accomplished with one external feed 322.

What is claimed is:

1. A multi-resonant antenna, comprising:

a plurality of resonators being radially disposed, at least one of said plurality of resonators being resonant at a frequency different from at least another of said plurality of resonators;

a circular feed member for capacitively feeding said plurality of resonators; and dielectric substrate means disposed between said plurality of resonators and said feed member.

2. The multi-resonant antenna of claim 1 wherein said at least one of said plurality of resonators is perpendicular to at least another of said plurality of resonators.

3. The multi-resonant antenna of claim 1 further comprising a feed line connected to said circular feed member at a center of said circular member.

4. The multi-resonant antenna of claim 3 wherein said feed line is external to said dielectric substrate means.

5. The multi-resonant antenna of claim 1 wherein each of said plurality of resonators overlay a portion of said circular feed member at its circumference.

* * * * *